US006913181B2

(12) United States Patent
Mochizuki et al.

(10) Patent No.: US 6,913,181 B2
(45) Date of Patent: Jul. 5, 2005

(54) STAPLER CARTRIDGE AND STAPLER APPARATUS COMPRISING THE SAME

(75) Inventors: Naoto Mochizuki, Yamanashi Prefecture (JP); Yosuke Sajiki, Yamanashi Prefecture (JP)

(73) Assignees: ACCO Brands, Inc., Lincolnshire, IL (US); NISCA Corporation, Yamanashi-Ken (JP)

( * ) Notice: Subject to any disclaimer, the term of this patent is extended or adjusted under 35 U.S.C. 154(b) by 0 days.

(21) Appl. No.: 10/450,062

(22) PCT Filed: Dec. 21, 2001

(86) PCT No.: PCT/IB01/02625

§ 371 (c)(1),
(2), (4) Date: Jun. 9, 2003

(87) PCT Pub. No.: WO02/053329

PCT Pub. Date: Jul. 11, 2002

(65) Prior Publication Data

US 2004/0217145 A1 Nov. 4, 2004

(30) Foreign Application Priority Data

Dec. 28, 2000 (JP) ..... 2000-402785

(51) Int. Cl.[7] ..... B27F 7/38
(52) U.S. Cl. ..... 227/120; 227/119; 227/131
(58) Field of Search ..... 242/423, 423.1; 227/119, 120, 131, 135, 136, 137, 138

(56) References Cited

U.S. PATENT DOCUMENTS 3,009,156 A * 11/1961 Lerner ..... 227/88
3,009,618 A * 11/1961 Lerner ..... 226/162
3,330,462 A * 7/1967 Colechia et al. ..... 227/136
3,602,414 A * 8/1971 Garfinkel ..... 226/151
4,518,109 A * 5/1985 Shiroyama ..... 227/109
4,585,154 A * 4/1986 Fealey et al. ..... 227/109
4,770,334 A 9/1988 Hoshi et al.
4,844,636 A * 7/1989 Paque ..... 400/208
4,913,332 A 4/1990 Olesen
5,121,868 A 6/1992 Jairam
5,273,199 A 12/1993 Logtens
5,683,024 A * 11/1997 Eminger et al. ..... 227/8
5,794,833 A * 8/1998 Strççt ..... 227/137
6,048,118 A * 4/2000 Martinez et al. ..... 400/208
6,050,471 A 4/2000 Yagi
6,152,346 A * 11/2000 Laubach ..... 227/109

* cited by examiner

*Primary Examiner*—Stephen F. Gerrity
*Assistant Examiner*—Nathaniel Chukwurah
(74) *Attorney, Agent, or Firm*—Michael Best & Friedrich, LLP

(57) ABSTRACT

A staple cartridge that sequentially draws out rolled staple band material from the staple storage portion includes regulating device that touches the stacked surface of the rolled staple band to regulate the widening and unraveling of the stacked surface. The regulating device is capable of regulating the widening of the stacked surface of the staple band material in the roll diameter direction even during vibration of the cartridge. This minimizes the phenomenon of the staple band material biting to or catching on the staple cartridge.

22 Claims, 4 Drawing Sheets

STAPLER CARTRIDGE AND STAPLER APPARATUS COMPRISING THE SAME

BACKGROUND OF THE INVENTION

This invention relates to a stapler apparatus that drives staples installed in a staple cartridge into a binding media (sheet bundle). In particular, it relates to a staple cartridge that can securely draw out staples for driving into a binding media.

Generally, this kind of stapler apparatus comprises a storage portion for storing bands of staples that link staples into a sheet and rolled is equipped with a staple cartridge for drawing out the staple band sequentially from this storage unit.

SUMMARY OF THE INVENTION

The staple band moves back into the storage portion of the staple cartridge by the vibrations that occur when moving to the staple driving position on the stapler apparatus or when driving staples into the binding media and the stack of rolled staple band material is undone by the rebounding from the shock with the inner wall of the staple cartridge. The stack spreads by being undone which results in the outer edge of the staple material roll to adhere to the inner wall of the staple cartridge. This causes friction between the inner wall of the staple cartridge and the outer edge of the staple band material making it stronger than the strength to draw the staple band from the staple cartridge causing the problem of not being able to pull the staple band out and the phenomenon of biting of the staple band material.

In view of the aforementioned issues, an object of the invention is to provide a staple cartridge in which it is difficult for the wound staple band material to unwind by the vibration applied to the staple band material wound into a roll shape and a stapler apparatus equipped with the same.

A staple cartridge comprises a storage portion for storing bands of staples that link staples into a sheet and rolled and sequentially draws the staple band from this storage unit, and is equipped with a regulating means that touches the stacked surface of the aforementioned staple band that is rolled and stacked for regulating the spreading out of the stacked surface.

The staple cartridge according to this invention uses a regulating means that touches the stacked surface of the staple band to regulate the movement of the rolled staple band that tends to move when receiving vibrations and spread out in the roll diameter direction. For example, even if the rolled outer surface of the staple band material touches in the inner wall of the staple storage portion, it can hold down the frictional force that occurs between the inner wall of the staple storage portion and the roller outer surface of the staple band material to within a range where it is not larger than the draw-out force of the staple band material from the staple storage portion to check the phenomenon of biting to the staple cartridge by the staple band material subsequently drawn out.

In the staple cartridge according to one aspect of the invention, the staple cartridge regulating means is equipped on the inner wall of the staple storage portion that face the stacked surfaces of the staple band.

The staple cartridge according to this invention equips the regulating means on the staple side surface to enable superior assembly and to hold down biting to the staple cartridge of the staple band being sequentially drawn out.

In the staple cartridge according to another aspect of the invention, the staple cartridge regulating means is composed of a regulating plate that faces the stacked surfaces of the staple band existing between the staple storage portion inner wall.

The staple cartridge according to this invention enables selecting for adjustment of the thickness of the regulating plate or the number of regulating plates. Different coefficients of friction can be selected according to the variations that can exist in the gap between the staple band stacked surfaces and the staple storage portion inner wall due to the state of the staple band and can be adjusted to hold down gouging of the staple cartridge of the staple band that is sequentially drawn out.

In the staple cartridge according to another aspect of the invention, the staple cartridge regulating means rotates following the staple band being drawn out.

The regulating means disposed on the staple cartridge according to this invention rotates following the staple band being drawn out so there is a substantial decrease in the load when drawing out to enable easy draw out, holding down the phenomenon of biting.

In another aspect, the invention includes a stapler apparatus equipped with a staple cartridge comprising a storage portion for storing bands of staples that link staples into a sheet and rolled. The stapler sequentially draws the staple band from this storage unit, and is equipped with a regulating means that touches the stacked surface of the aforementioned staple band that is rolled and stacked for regulating the spreading out of the stacked surface.

The staple cartridge used in the stapler apparatus according to this invention receives the vibrations from the system when installing the stapler apparatus, the vibrations caused by the stapler apparatus driving the staples or the vibrations applied when stored before installing to the stapler apparatus, and holds down the unraveling of the rolled staple band and the gouging to the staple cartridge of the staple band being sequentially drawn out. This is accomplished by the staple band stacked surfaces being supported by the regulating means.

Below, an embodiment of the stapler apparatus according to the present invention will be described in accordance with the figures.

DESCRIPTION OF THE REFERENCE NUMERALS

Figure 1:
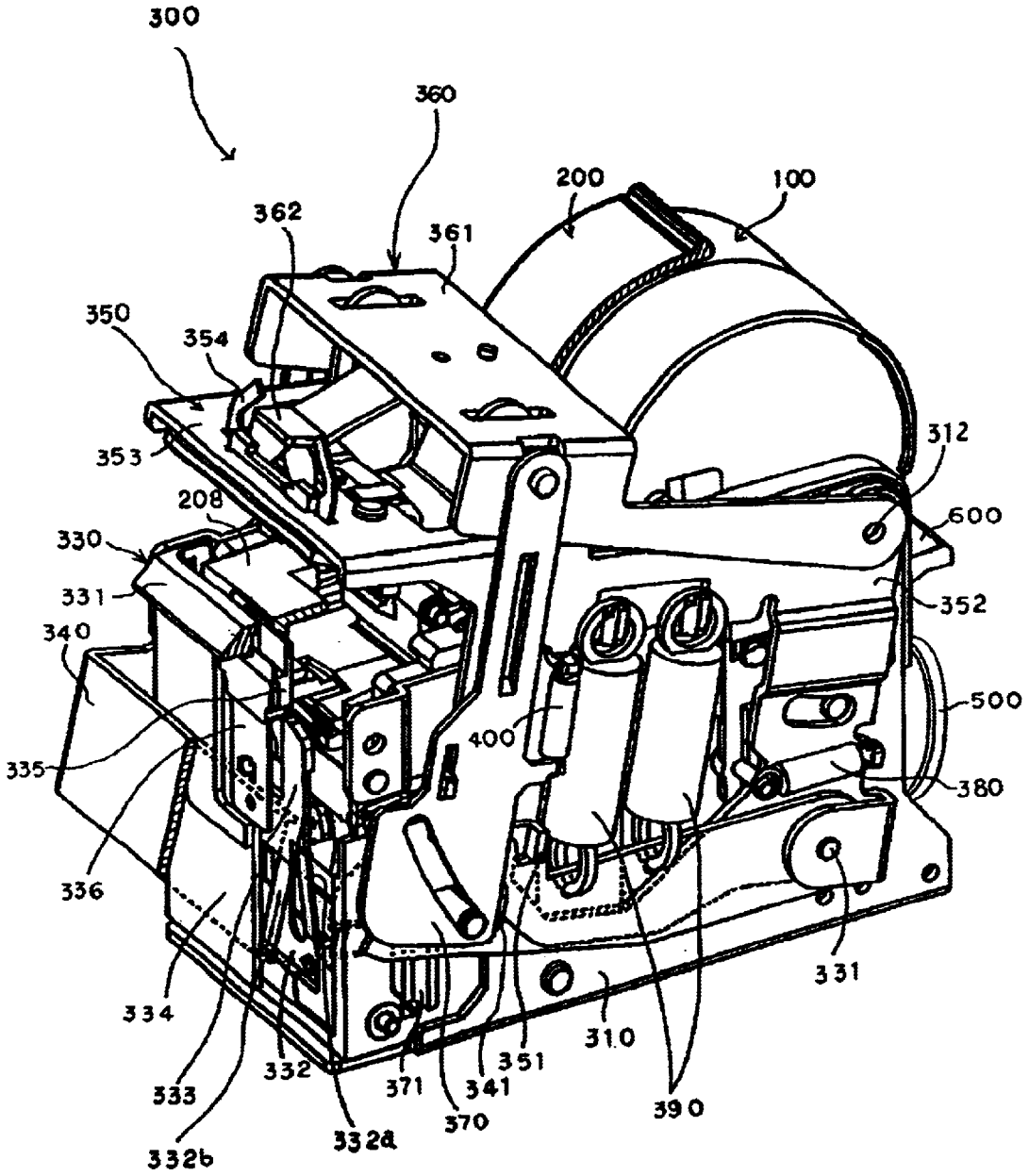
FIG. 1 is a plan view comprising a sectional view of a stapler device mounted with the staple cartridge according to the embodiment of the instant invention.

100 Staple cartridge
101 Staple band material
101*a*, 101*b* Stack surfaces
102 Staple storage portion
200 Cartridge holder

300 Stapler unit
700 Regulating means (Regulating plate)

DETAILED DESCRIPTION

FIG. 1 is an external perspective view showing a section of part of the entire stapler apparatus, mainly comprising the staple cartridge 100, the cartridge holder 200 and the stapler unit 300.

Firstly, to describe the apparatus according to the sequence of its assembly, the stapler unit 300 comprises the unit frame 310, the electric drive unit, not shown in the figures, the staple head unit 330, the actuating lever 340, the anvil unit 350, the clincher unit 360, the interlock lever 370, the anvil spring 380, the paper thickness absorbing spring 390, the clincher spring 400 and the manual drive plate 500.

Figure 2:
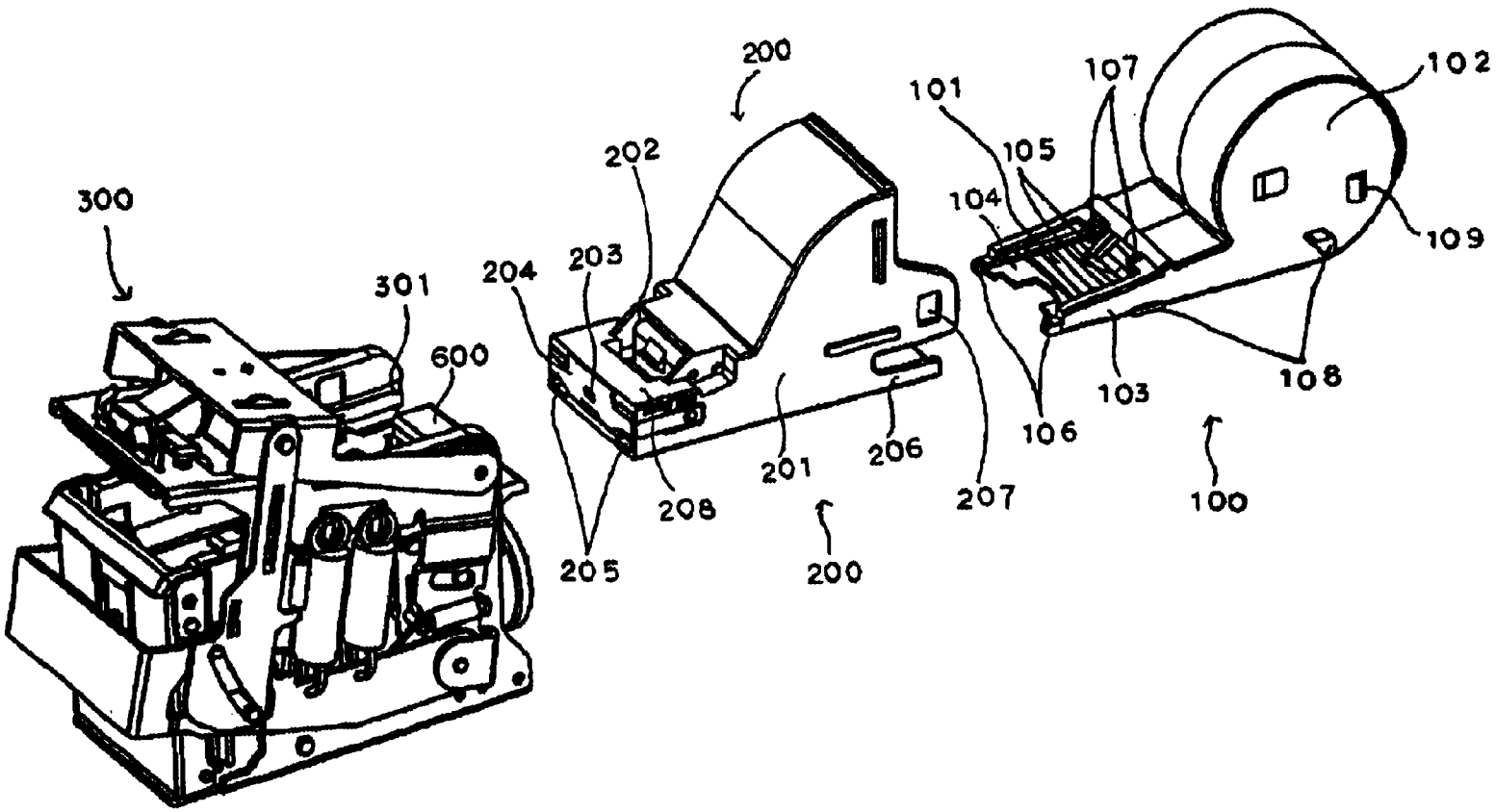
FIG. 2 is a plan view of the disassembled units of the stapler device mounted with the staple cartridge according to the embodiment of the instant invention.

The unit frame 310 is sheet metal pressed formed into a sectional U-shape comprising sides established left, right and a bottom. It internally holds the electric drive unit, thereabove the holder guide 301, which is shown in FIG. 2 and the staple head unit 330 in the leading edge and properly supports other units on the outside side walls thereof.

Note that the electric drive unit, which is not shown in the figures, is composed of a direct current motor that is the stapler drive source, the gear train that decelerates the rotation of the motor to a determined rotating speed and the transmission cams that are decelerated to the determined speed and rotate. Each transmission drives the staple head unit 330 and the anvil unit 350 via the actuating lever 340 and the interlock lever 370 and by driving the clincher unit 360 it controls the series of operations of the stapler.

The staple head unit 330 comprises the sheet loading table 331, the driver 332, the former 333, the sheath 334 and the bending block 335.

Furthermore, the staple head unit 330 starts the upward direction displacement of the driver 332 pressed formed with a leaf spring material by the driver drive cam pin disposed on the last level of the electric drive unit.

Displacement of the driver 332 abuts the former abutting piece 332*a* on the driver 332 against the former 333. The driver 332 and former 333 follow a stepped surface, not shown in the figures, formed on the sheath 334 upward to a position where that abutment is released.

The former 333 bends into a U-shape staples drawn to the staple bending position of the bending block bending block 335 and holds to guide U-shaped staples on the sides of the former 333 thereof to enable driving. Note that the position where the staple is bent by the former 333 corresponds to the staple driving position below.

In this state, the driver 332 released from abutting the former 333 by the protrusion, not shown in the figures, formed at the sheath 334 is displaced further upward leaving the former 333 in that position.

By displacing upward, the staple driving unit 332*b* positioned at the leading edge of the driver 332 displaces the bending block 335 to the front from the region of movement of the driver 332 and retracts.

The staple driving unit 332*b* of the driver 332 displaced further upward separates from the adhesive staples that have been bent and are adhering to the next staple by adhesive tape. Formed and separated staples are driven by the binding media.

Next, the actuating lever 340 has arms extending left and right along the side surfaces of the anvil unit 350. While nipping in the unit frame 310, they are supported by the interlocking pivot shaft 331 disposed on the anvil unit 350 sides.

In addition, the paper thickness absorbing springs 390 are stretched between the anvil unit 350 in a central location on the left and right arms of the actuating lever 340. These springs 390 constantly urge in the counterclockwise direction around the interlocking pivot shaft 331 to contact with the stopper 351 formed on the anvil unit 350.

The notch 341 comprising an edge to abut with the anvil drive lever, which is not shown in the figures, driven to displacement by the electric drive unit is formed on the leading edge of the arm positioned on the other edge of the left and right arms. The anvil drive lever swings it clockwise around the interlocking pivot shaft 331 which is pressed and urged downward.

The anvil unit 350, the anvil rocking pivot 352 on one side thereof rockingly supported on the pivot shaft 312 on the unit frame 310, is constantly rotatingly urged in the clockwise direction by the anvil spring 380 around the pivot shaft 312.

The anvil head 353 on the other side follows the rocking of the actuating lever 340 and rocks counter-clockwise resisting the urging force of the anvil spring 380 to nip and support the binding media at a position that corresponds to the thickness thereof.

Note that after the anvil unit 350 nips and supports the binding media by the paper thickness absorbing springs 390, the actuating lever 340 continues acting alone in resistance to the resilient force of the paper thickness absorbing springs 390 because the anvil unit 350 is locked in that nipping position.

To the anvil head 353 that nips the binding media on the anvil unit 350, the clincher unit 360 that has the left and right paired clinchers 354 for bending the leading edges of staples that have penetrated the binding media driven from below the binding media, is disposed to follow.

The clincher unit 360 comprises the clincher lever 361 and is supported by the pivot shaft 312 on the unit frame 310 which is also the pivot for the anvil rocking pivot 352 on the anvil unit 350. To the leading edge of the clincher unit 360 is mounted the clincher head 362 that bends staples that have been driven and rocks the clincher 354 mounted to the anvil head 353 on the anvil unit 350.

The clincher head 362 is press formed using a steel plate for a spring with a thickness of 1.5 mm while the clincher lever 361 is formed using a plated steel plate of a thickness of 2.0 mm, to absorb the difference in pressing stroke of the clincher 354.

Next, the interlock lever 370 follows the rocking of the anvil unit 350 via the clincher spring 400 to rock the clincher unit 360 and is disposed to continue rotating with the rocking of the clincher drive lever, not shown in the drawings, while the anvil unit 350 nips and stops the binding media and after the anvil unit 350 stops at the nipping position that corresponds to the thickness of the binding media, it continues rotating to bend the staples.

The manual drive plate 500 is for resetting stapling defects by manually operating the stapler when a staple is not properly driven into the binding media and the defective staple prevents the stapler apparatus from operating and thus causes a stapling problem. The manual drive plate 500 is mated to the rotating shaft extending to the back side of the output shaft of the direct current motor of the electric drive unit, which is not shown.

FIG. 2 is an exploded perspective view showing the cartridge holder 200 and staple cartridge 100 that are mounted on the stapler unit 300 in FIG. 1 pulled out.

When pulling from the stapler unit 300, first the cartridge lock lever 600 which abuts the staple cartridge 100 and urgingly supports in the mounting direction is manually pressed downward to release the abutting. Then, the staple cartridge 100 is pulled from the cartridge holder 200.

Then, the cartridge holder 200 is pulled from the stapler unit 300. Conversely, it is also possible to remove the staple cartridge 100 from the cartridge holder 200 after pulling out the cartridge holder 200 while the staple cartridge 100 is mounted to the cartridge holder 200.

Note that the reverse procedures are acceptable when mounting the staple cartridge 100 and cartridge holder 200 to the stapler unit 300.

The staple cartridge 100 is composed of a semi-transparent plastic case and comprises the storage unit 102 that stores the staple band material 101 into which sheets of a plurality of straight staples linked into a band are wrapped into a roll, and the pull-out guide 103 for pulling out the staple band material 101.

The pull-out guide 103 is mounted to the cartridge holder 200 and is equipped with the opening 104 of the guide surface on the leading top side being widely cut away to abut the staple feed means 202 on the cartridge holder 200, the back-feed stopper pawl 105 to arrest so that the staple band material 101 pulled out from the storage unit 102 does not return back into the storage unit 102, and the leading edge stopper 106 that restricts the leading edge of the staple band material 101 that has been pulled out and that positions the leading edge thereof at the binding position while mounted to the stapler unit 300.

Also, it comprises the feed pawl advancing protrusion 107 that protrudes into the guide surface on the top-side of the leading edge formed on the opening 104 on the pull-out guide 103 and advances the staple feed means 202 when mounting to the cartridge holder 200 to press the leading edge of staples in the staple band material 01 to the edge stopper 106.

Furthermore, to both sides of the staple cartridge 100 are equipped the guide protrusion 108 guided when mounting to the cartridge holder 200 and the stopper pawl 109 stopped when mounting to the cartridge holder cartridge holder 200.

Though not shown in the figures, it is possible to bend open the bottom portion of the staple cartridge 100 from an appropriate position on the back-feed stopper pawl 105 and the edge stopper 106 to the storage unit 102. By opening, the back-feed stopper pawl 105 is released from stopping the staple band material 101 thereby making it possible to discard all remaining staples when discarding.

The cartridge holder 200 is composed of the holder unit 201, the staple feed means 202, the magnet 203, the guide plate 204 comprising a non-magnetic body, the opening 205, the guide 206, the abutting hole 207 and the auxiliary table 208.

The holder unit 201 is formed of a plastic material to cover the front half of the staple cartridge 100.

The staple feed means 202 is rockingly supported on the holder unit 201 and is constantly urged to the staple pull-out direction by a leaf spring, which is not shown in the figures. It is interlocked to the nipping action of the binding means by the anvil unit 350 and charged. It comprises a feed pawl for pressing the staple sheet surface of the staple band material 101 with the recovery action caused by the release of the charge to advance the staple band material 101.

The magnet 203 and the guide plate 204 faces the staple to be driven at the binding position when mounted to the stapler unit 300 and the magnetic attraction of the magnet attracts mis-driven staples to discharge them outside from the stapler unit 300.

The opening 205 is for setting the leading edge of the stopper 106 on the staple cartridge 100 and the leading edge of the staple to protrude and be set at the binding position.

The guide 206 is for guiding the guide protrusion 108 on the staple cartridge 100 and is composed of a cut-out groove and a bottom surface.

The abutting hole 207 abuts the stopper pawl 108 on the staple cartridge 100 and it is one of the supplementary stopping means on the staple cartridge 100 until the staple cartridge 100 is locked by the cartridge lock lever 600.

The supplementary table 208 acts as the loading table where the binding media is loaded along with the table 331 on the staple head unit 330, as shown in FIG. 1, when mounted to the stapler unit 300.

Figure 3:
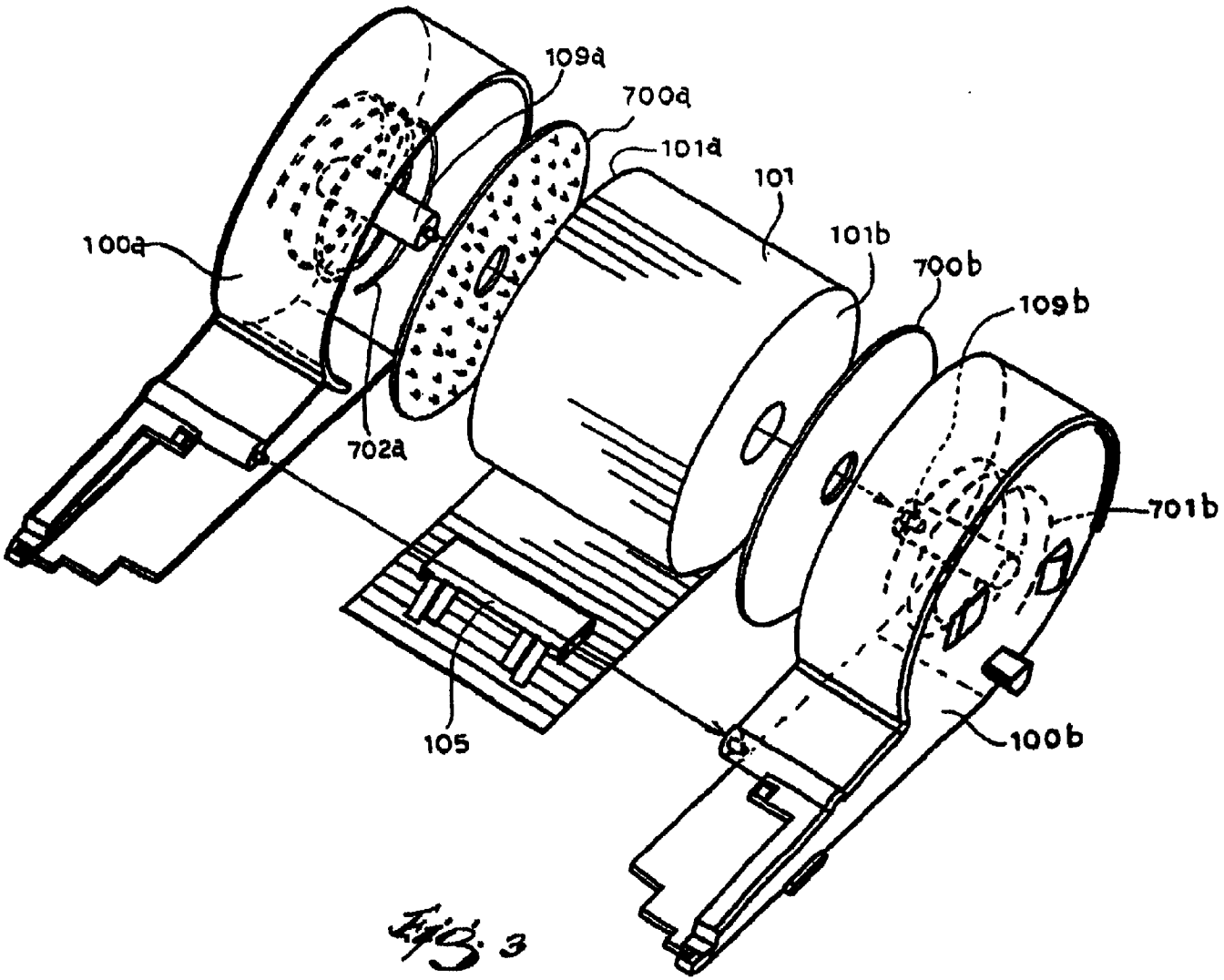
FIG. 3 is a disassembled perspective view of the staple cartridge according to the invention.

FIG. 3 shows the staple cartridge 100 disassembled. To describe the order of assembly, one of the two separated pieces of the staple cartridge, the cover 100*b*, mates with the urging means 701 on the support shaft 109*b* on the cover 100*b*. While mated to the regulating means 700*b* to regulate the unraveling of the stacked surface 101*a* on the staple band 101, the staple band member is mated to the cover 100*b* from above. Then, pressing the urging means 702 to the shaft 109*a* on the other cover 100*a*, it mates and covers the regulating means 700*a*. Finally, assembly is completed by inserting the return stopper pawl 105 to the staple band member 101.

Particularly, the surfaces of the regulating means of 700*a* and 700*b* facing the stacked surfaces 101*a* and 101*b* on the staple band material 101 can hold to a degree where it does not easily move even if there is a vibration, the rough surface considering the urging force of the urging means 701 and 702. For example, with a surface that catches, such as VELCRO, hook and loop fasteners when there is no vibration, the forces to regulate the unraveling while in contact with the stacked surface of the staple band material 101 do not act together, however when there is vibration, they act mutually to not displace the relative positions by the vibrations to the staple band material 101. This makes it possible to hold down the frictional force that occurs between the inner wall of the staple storage portion and the staple band material rolled surface to within a range that is not larger than the draw out force of the staple band material from the staple storage portion and check the phenomenon of biting to the staple cartridge of the staple band material subsequently drawn out, when the rolled staple band material widens in the rolled diameter direction, even when the rolled outside surface of the staple band material touches the inner wall of the staple storage portion.

Also, the regulating means 700*a* and 700*b* are the regulating plates rotatingly supported to the staple storage portion 102. The surfaces of the regulating means 700*a* and 700*b* facing the staple storage portion 102 slide easily and follow the rotation of the roller portion when drawing out the staple band member 101 to enable it to rotate. For example, their surfaces can be a metal plate such as aluminum that is thin and planar, the catching side portion of the aforementioned VELCRO, hook and loop fasteners being affixed to the metal plate.

Also, the regulating surface of the regulating means 700*a* and 700*b* can be pointed needles such as those used in flower arrangement, rather than the catching part of the aforementioned VELCRO hook and loop fasteners. Furthermore, it is possible to regulate the displacement by the vibration of the staple band with the reverse action caused by the elastic deformation when elastically deforming by the needle tips of the staple band material that vibrate.

Figure 4:
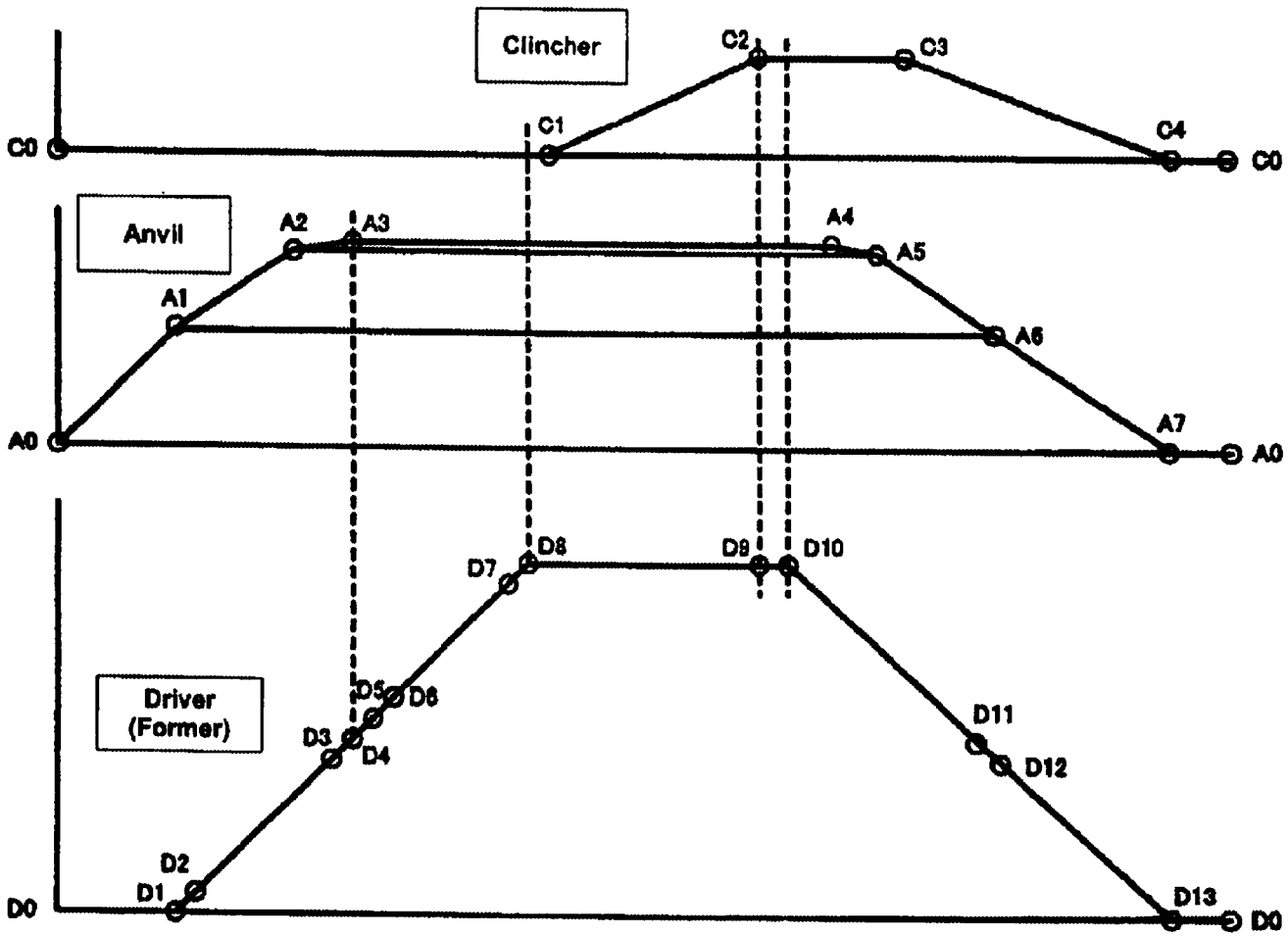
FIG. 4 is a timing chart of the operations of the stapler apparatus mounted with the staple cartridge according to the invention.

FIG. 4 is a timing charge to illustrate the operation of each of the driver, former, anvil and clincher units' processes. The horizontal axis indicates the angle of rotation of the drive cam that drives each unit and the vertical axis shows the amount of displacement of the levers for each unit. The following generally describes the series of actions according to FIG. 1.

Initially, along with the setting to the stapling position of the binding media a staple execution instruction signal is output to the stapler apparatus from an outside source.

The instruction signal starts the rotation of the direct current motor in the electric drive unit, which is not shown in the drawings, first pushing the actuating lever 340 in the downward direction by the anvil drive cam, which is not shown in the drawings, resisting the anvil spring 380.

Following the displacement of the actuating lever 340, the anvil unit 350 moves downward to start nipping the binding media.

Note that interlocked to the nipping of the anvil unit 350, the clincher unit 360 interlocked by the interlock lever 370 and the clincher spring 400 follows the anvil unit 350.

In describing the operation of the anvil unit 360, beginning from the idling position A0, rocking stops at a nipped position according to the thickness (the number of sheets) of the binding media set at the binding position, between the position A1 where, for example, 100 pages of binding media are nipped to the position A2 where 0 pages are nipped of binding media.

After nipping the binding media by the anvil unit 360, only the actuating lever 340 continues displacement resisting the paper thickness absorbing springs 390. The anvil unit 360 maintains a displaced state to the position equivalent to the position A3 by applying an over-stroke to the position A2 to enable the secure nipping even if there are 0 pages of binding media, in consideration of variations in parts and their assembly, to complete the nipping operation of the binding media using the anvil unit 360.

Before operating to the position A3 to complete the nipping operation of the binding media using the anvil unit 360, the driver drive cam CA40, shown in FIG. 4 displaces the driver 332, which is not shown in the drawing, upward, and the former 333 following this displacement is pressed upward.

The driver 332 begins moving from the position D1 when the clincher unit 360 is beyond the position A1, at position D2, the former 333 presses the staple drawing to the driving position and starts forming the staple into a U-shape. In the continuing stroke, by pushing both leading edges of bent staples formed into that shape against the sides of the bending block 335 to guide it, both leading edges of the staple are secured front, back left and right by the non-magnetic materials of the guide plate 204 walls composed of the former 333, the bending block 335 and the cartridge holder 200.

Then, the leading edges that touch the formed staple of the driver 332 are pressed into the oblique surfaces of the bending block 335. The leading edge portion of the driver 332 touches the formed staple at the position D3 with the bending block 335 retracted from the area of movement of the leading edge of the driver 332. The leading edge of the formed staple pressed by the driver 332 delayed from the position A3 where the anvil 350 nips the binding media reaches the position D4 that touches the surface of the sheet of the binding media to start driving the formed staple into the binding media by the driver 332.

After the driver 332 starts driving the staple, at the same time that the abutting portion that was abutting the former 333 on the driver 332 is released from abutting, by the level protrusion on the sheath 334 at the slightly delayed position D5, the former 333 is released from abutting with the driver 332 at the position D6 just prior to the leading edge of the former 333 touching the surface of the sheets in the binding media and the former 333 stops and the former guides the bend staple driven by the driver 332.

Continuing on, the formed staple is driven by the driver 332, and after the formed staple crown touches the surface of the sheets in the binding media at the position D7, the driver 332 is further driven by the driver drive cam at the position D8, but because the driver 332 cannot press the formed staples in, the driver 332 comprising a leaf spring, itself is elastically deformed the amount of the over-stroke to absorb the difference of the mounting position to securely drive the formed staple.

The clincher unit 360 is rocked by the clincher drive unit 602 pressed downward by the clincher drive cam CA10 shown in FIG. 11 from position C1 immediately after the position D8 where the formed staple is driven by the driver 332, pressing the clincher 354 to complete the clinching operation at the position C2 by bending the leading edges of the staples that have penetrated the binding media.

After the clinching operation is completed, first, the recover operation is started for the driver 332 at the position D11. The former 333 partway is re-interlocked and returned to the position D0 which is equivalent to the initial position passing through the positions of D12 and D13.

The anvil unit 350 recovery operation is started slightly delayed to the recovery operation of the driver 332 and is returned to the position A7 which is equivalent to the initial position passing through the position A6.

Finally, the anvil unit 360 recovery operation is started slightly delayed to the recovery operation of the driver 350 and is returned to the position C4 which is equivalent to the initial position to complete the series of the staple operation.

What is claimed is:

1. A staple cartridge comprising:

a staple storage portion for storing a rolled band of staples linked in a sheet, the staple storage portion including an inner wall; and a regulating means distinct from the inner wall for engaging a stacked surface of the rolled band of staples and regulating the spreading out of the stacked surface to thereby minimize the likelihood of the rolled band of staples becoming unwound and expanding within the staple storage portion;

wherein the regulating means includes a regulating plate between the inner wall of the staple storage portion and the stacked surface of the rolled band of staples, and wherein the regulating plate rotates as the rolled band of staples is drawn out of the staple storage portion.

2. The staple cartridge according to claim 1, wherein the regulating means is disposed adjacent the inner wall of the staple storage portion facing the stacked surface of the rolled band of staples.

3. The staple cartridge according to claim 1, wherein the regulating plate includes a textured surface for engaging the stacked surface.

4. The staple cartridge according to claim 3, wherein the textured surface includes hook and loop fasteners.

5. The staple cartridge according to claim 3, wherein the textured surface includes a plurality of needle-like projections.

6. The staple cartridge according to claim 1, wherein the regulating means further comprises a second regulating plate on an opposite side of the rolled band of staples from the said regulating plate for engaging a second stacked surface of the rolled band of staples.

7. The staple cartridge according to claim 1, wherein the regulating plate is biased toward the stacked surface of the rolled band of staples.

8. The staple cartridge according to claim 7, further comprising a spring positioned between the inner wall and the regulating plate for biasing the regulating plate toward the stacked surface of the rolled band of staples.

9. The staple cartridge according to claim 1, further comprising a shaft extending from the inner wall, and wherein the regulating plate is rotatably supported on the shaft.

10. A stapler comprising:

a frame, and a staple cartridge removably coupled to the frame, the staple cartridge including a staple storage portion for storing a rolled band of staples linked in a sheet, the staple storage portion including an inner wall; and a regulating means distinct from the inner wall for engaging a stacked surface of the rolled band of staples and regulating the spreading out of the stacked surface to thereby minimize the likelihood of the rolled band of staples becoming unwound and expanding within the staple storage portion;

wherein the regulating means includes a regulating plate between the inner wall of the staple storage portion and the stacked surface of the rolled band of staples, and wherein the regulating plate rotates as the rolled band of staples is drawn out of the staple storage portion.

11. The stapler according to claim 10, wherein the regulating means is disposed adjacent the inner wall of the staple storage portion facing the stacked surface of the rolled band of staples.

12. The stapler according to claim 10, wherein the regulating plate includes a textured surface for engaging the stacked surface.

13. The stapler according to claim 12 wherein the textured surface includes hook and loop fasteners.

14. The stapler according to claim 12, wherein the textured surface includes a plurality of needle-like projections.

15. The stapler according to claim 10, wherein the regulating means further comprises a second regulating plate on an opposite side of the rolled band of staples from the said regulating plate for engaging a second stacked surface of the rolled band of staples.

16. The stapler according to claim 10, wherein the regulating plate is biased toward the stacked surface of the rolled band of staples.

17. The stapler according to claim 16, further comprising a spring positioned between the inner wall and the regulating plate for biasing the regulating plate toward the stacked surface of the rolled band of staples.

18. The stapler according to claim 10, further comprising a shaft extending from the inner wall, and wherein the regulating plate is rotatably supported on the shaft.

19. A staple cartridge comprising:

a staple storage portion for storing a rolled band of staples linked in a sheet, the staple storage portion including an inner wall; and a regulating means distinct from the inner wall for engaging a stacked surface of the rolled band of staples and regulating the spreading out of the stacked surface to thereby minimize the likelihood of the rolled band of staples becoming unwound and expanding within the staple storage portion;

wherein the regulating means is biased toward the stacked surface of the rolled band of staples.

20. The staple cartridge of claim 19, further comprising a spring positioned between the inner wall and the regulating means for biasing the regulating means toward the stacked surface of the rolled band of staples.

21. The staple cartridge of claim 19, wherein the regulating means includes a regulating plate between the inner wall of the staple portion and the stacked surface of the rolled band of staples.

22. The staple cartridge of claim 19, wherein the regulating means includes a textured surface for engaging the stacked surface.

* * * * *